US005532789A

United States Patent [19]

Yaginuma et al.

[11] Patent Number: 5,532,789

[45] Date of Patent: Jul. 2, 1996

[54] ELECTROSTATIC COPIER HAVING A MARKING UNIT FOR INDICATING UNNECESSARY PRINT MATTER ON ONCE-USED PAPER

[75] Inventors: Shigeru Yaginuma, Machida; Junichi Yamamoto, Hadano, both of Japan

[73] Assignee: Minolta Camera Kabushiki Kaisha, Osaka, Japan

[21] Appl. No.: 702,881

[22] Filed: May 20, 1991

[30] Foreign Application Priority Data

May 25, 1990 [JP] Japan ..... 2-133734
Apr. 15, 1991 [JP] Japan ..... 3-081081

[51] Int. Cl.[6] ..... G03G 15/00

[52] U.S. Cl. ..... 355/202; 355/311; 283/901

[58] Field of Search ..... 355/201, 202, 355/244, 311, 24; 358/462, 464; 101/188, 703, 708, 719; 283/72, 901

[56] References Cited

U.S. PATENT DOCUMENTS

| | | | |
|---|---|---|---|
| 3,940,210 | 2/1976 | Donohue | 355/24 X |
| 4,573,409 | 3/1986 | Clar et al. | 283/901 X |
| 4,609,283 | 9/1986 | Murata et al. | 355/325 |
| 4,973,036 | 11/1990 | Yamashita et al. | 270/53 |
| 5,051,779 | 9/1991 | Hikawa | 355/200 |

FOREIGN PATENT DOCUMENTS

| | | | |
|---|---|---|---|
| 1-283581 | 11/1989 | Japan | 355/202 |

*Primary Examiner*—John E. Barlow, Jr.
*Attorney, Agent, or Firm*—Willian Brinks Hofer Gilson & Lione

[57] ABSTRACT

The image forming apparatus, in forming an image on the blank surface of a recording paper the one-side surface of which has an image already formed thereon for the purpose of promoting further utilization of the recording paper, forms on the aforementioned one-side surface of the recording paper a mark indicating unnecessariness of the image already formed on the one-side surface. This apparatus is provided with a marking unit capable of inscribing on the used surface having an unnecessary image recorded thereon a mark indicating unnecessariness of this image. This marking unit is actuated only when the fact that the reverse surfaces of recording papers have unnecessary image information already recorded thereon is detected, when the fact that the particular one of a plurality of paper feeding trays which accommodates used recording papers has been designated is detected, or when recording papers have been supplied from the paper feeding tray accommodating used recording papers. The choice between setting a marking mode in which the mark is printed by the marking unit on the reverse surface and canceling this mode is made by a selection switch.

18 Claims, 12 Drawing Sheets

ELECTROSTATIC COPIER HAVING A MARKING UNIT FOR INDICATING UNNECESSARY PRINT MATTER ON ONCE-USED PAPER

BACKGROUND OF THE INVENTION

1. Field of the Invention

This invention relates to an image forming apparatus for forming an image as with a printer or a copying device on blank surfaces of recording papers whose one-side surfaces have been already used for recording information such as of characters.

2. Description of the Prior Art

In recent years, the volume of consumption of quality paper has been increasing at a fairly high rate in consequence of conspicuous dissemination of such office automation devices as copying devices and printers. In the meantime, reckless deforestation has been raising a global ecological issue. Enterprises which are relatively large paper consumers, anxious about this grave situation and eager to make further use of those papers which have been used for printing or copying information on only one-side surfaces thereof with a printer or a copying machine, have come to follow the practice of making full use of the blank surfaces of these used papers.

When the blank surfaces of the used papers are utilized for printing characters or color images with a printer or copying information with a copying device and when the image information newly recorded on the blank surfaces of the used papers bears similarity to the image information previously recorded on the one-side surfaces of the papers, these papers have the possibility of defying clear distinction between the surfaces bearing a newly recorded image information and those bearing a formerly recorded image information. The confusion of this nature may not occur immediately after the printing of the new image information is completed. Once the papers having image information recorded on both the opposite surfaces thereof are filed, a person trying to retrieve necessary image information from the file may be possibly prevented from easily discriminating between the opposite surfaces of the papers.

SUMMARY OF THE INVENTION

An object of this invention is to provide, for the formation of image information on blank surfaces of recording papers whose one-side surfaces have been already used for formation of image information, an image forming apparatus which is provided with a marking unit capable of inscribing on the aforementioned one-side surfaces a mark indicating the unwanted side of the paper.

A further object of this invention is to provide an image forming apparatus which is furnished with a first paper feeding tray for accommodating used recording papers having an image already formed on the reverse surfaces thereof, a second paper feeding tray for accommodating unused recording papers having no image recorded yet on either of the opposite surfaces thereof, and a sensor for discerning the position of the first paper feeding tray and which is adapted to print a mark on the reverse surfaces of the recording papers accommodated in the first paper feeding tray.

Another object of this invention is to provide an image forming apparatus which is furnished at a designated position with a paper feeding tray for accommodating used recording papers having an image already formed on the reverse surfaces thereof and is adapted to print a mark on the reverse surfaces of the recording papers transported from the tray.

Still another object of this invention is to provide an image forming apparatus which is furnished with a sensor for discerning the presence or absence of unwanted information formed on the reverse surfaces of recording papers transported from a paper feeding tray accommodating the recording papers and is adapted, when the sensor discerns the presence of the unwanted information recorded on the reverse surfaces of the recording papers, to print a mark on the reverse surfaces of the recording papers.

Yet another object of this invention is to provide an image forming apparatus which is furnished with a marking unit for inscribing a mark indicating unnecessariness of the image information already recorded on the reverse surfaces of recording papers and an image forming unit for forming images on the obverse surfaces of the recording papers and is adapted to form new images on the obverse surfaces of the recording papers as desired and inscribe on the reverse surfaces of the recording papers a mark indicating unnecessariness of already recorded images.

A further object of this invention is to provide an image forming apparatus which is furnished with a selecting switch for effecting selection between the marking mode for printing a mark on the reverse surfaces of recording papers and the non-marking mode for printing no mark on the reverse surfaces.

A still further object of this invention is to provide an image forming apparatus which is furnished with a conveyor for conveying recording papers from a paper feeding tray accommodating recording papers to a paper discharging tray accommodating recording papers on which a mark has been already printed and is adapted to inscribe a mark on the reverse surfaces of the recording paper being transported on the conveyor.

In accordance with the present invention, there is provided an image forming apparatus comprising: discerning means for discerning the presence or absence of information on a reverse surface of a recording paper; marking means disposed on a downstream side of said discerning means in the direction of conveyance of the recording paper for marking on the reverse surface of the recording paper having image information already recorded thereon a mark indicating that the image information is unnecessary; selecting means for selecting marking mode or non-marking mode; and control means for controlling said marking means when said marking mode is selected by said selecting means.

DESCRIPTION OF THE PREFERRED EMBODIMENTS

Figure 1:
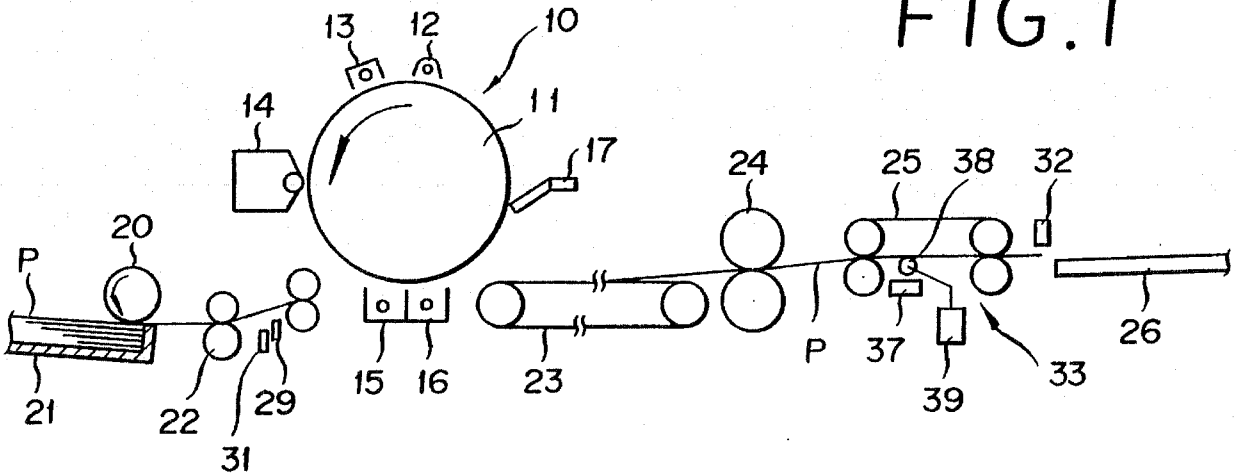
FIG. 1 is a cross section schematically illustrating the constructions of an image forming unit and a recording paper conveying path in a copying device embodying the present invention.

FIG. 1 is a cross section schematically illustrating an image forming unit 10 in a copying device. In this diagram is illustrated a recording paper conveying path for conveying a recording paper from a paper feeding part to the image forming unit 10 and, at the same time, conveying a recording paper having an image already formed thereon toward a paper discharging part.

Around a photosensitive drum 11 which is installed inside a copying device, an eraser lamp 12, an electric charger 13, a developing unit 14, a transfer charger 15, a separation charger 16, and a cleaning unit 17 are disposed. The photosensitive drum 11 is provided on the surface thereof with a photosensitive layer and is rotated counterclockwise as illustrated. This photosensitive drum 11 is uniformly charged electrically as it passes the eraser lamp 12 and the electric charger 13. The surface of this photosensitive drum 11, on exposure to the light emitted from an optical system (not shown) and passed through a given image, forms a corresponding electrostatic latent image thereon. This electrostatic latent image is developed by the developing unit 14 to form a corresponding toner image on the surface of the photosensitive drum 11. In the meantime, a recording paper is taken out of a paper feeding cassette or a paper feeding tray 21 by a paper feeding roller 20 and sent out toward the photosensitive drum 11 through the medium of a riffling roller 22. The toner image mentioned above is transferred by the transfer charger 15 onto a recording paper P which is conveyed synchronously with the rotation of this photosensitive drum 11. The recording paper onto which the toner image has been already transferred is separated by the separation charger 16 from the surface of the photosensitive drum 11, conveyed on a conveyor belt 23, treated by a fixing unit 24 for the fixation of the toner image thereon, and thereafter conveyed toward a paper discharging tray 26 by a paper discharging belt 25. In the meantime, the photosensitive drum 11 after the transfer is relieved of the toner and the electric charge remaining on the surface thereof by the cleaning unit 17 and the eraser lamp 12 and is consequently readied for the next copying operation.

Inside the paper feeding tray 21, the recording paper P the one-side surface of which has been already used for recording image information such as of characters is accommodated in such a manner that the blank surface thereof having no image information recorded thereon faces upwardly. In other words, the recording paper P is so held inside the paper feeding tray 21 that the aforementioned one-side surface thereof having the image already formed thereon faces downwardly.

Figure 2:
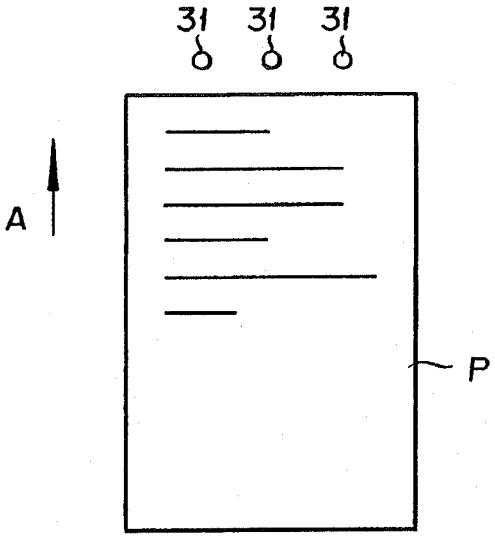
FIG. 2 is a layout diagram illustrating the positions of reverse surface information detecting sensors disposed as shown in FIG. 1 relative to recording papers and the number of the sensors.

The recording paper P is moved through the aforementioned conveying path extending from the paper feeding tray 21 to the paper discharging tray 26. In the part of this conveying path which intervenes between the riffling roller 22 and the photosensitive drum 11, there is installed a reverse surface information sensor 31 which serves the purpose of discerning the presence or absence of an already recorded image information on the reverse surface of the recording paper being conveyed. Between the paper discharging belt 25 and the paper discharging tray 26, there is installed a paper discharging sensor 32 which serves the purpose of sensing the completion of discharge of the recording paper P. As illustrated in FIG. 2, three reverse surface information sensors 31 are disposed as regularly separated in a direction substantially perpendicular to the direction of conveyance of the recording paper P indicated by the arrow A.

A marking unit 33 is disposed in the central part of the paper discharging belt 25 and is so adapted that, when the fact that the recording paper P transferred from the paper feeding tray 21 has information already recorded on the rear surface thereof is detected by the reverse surface information sensor 31, a mark indicating the unnecessariness of recorded information is inscribed on the reverse surface of the recording paper P the obverse surface of which has the image already formed thereon by the image forming unit 10.

Figure 3:
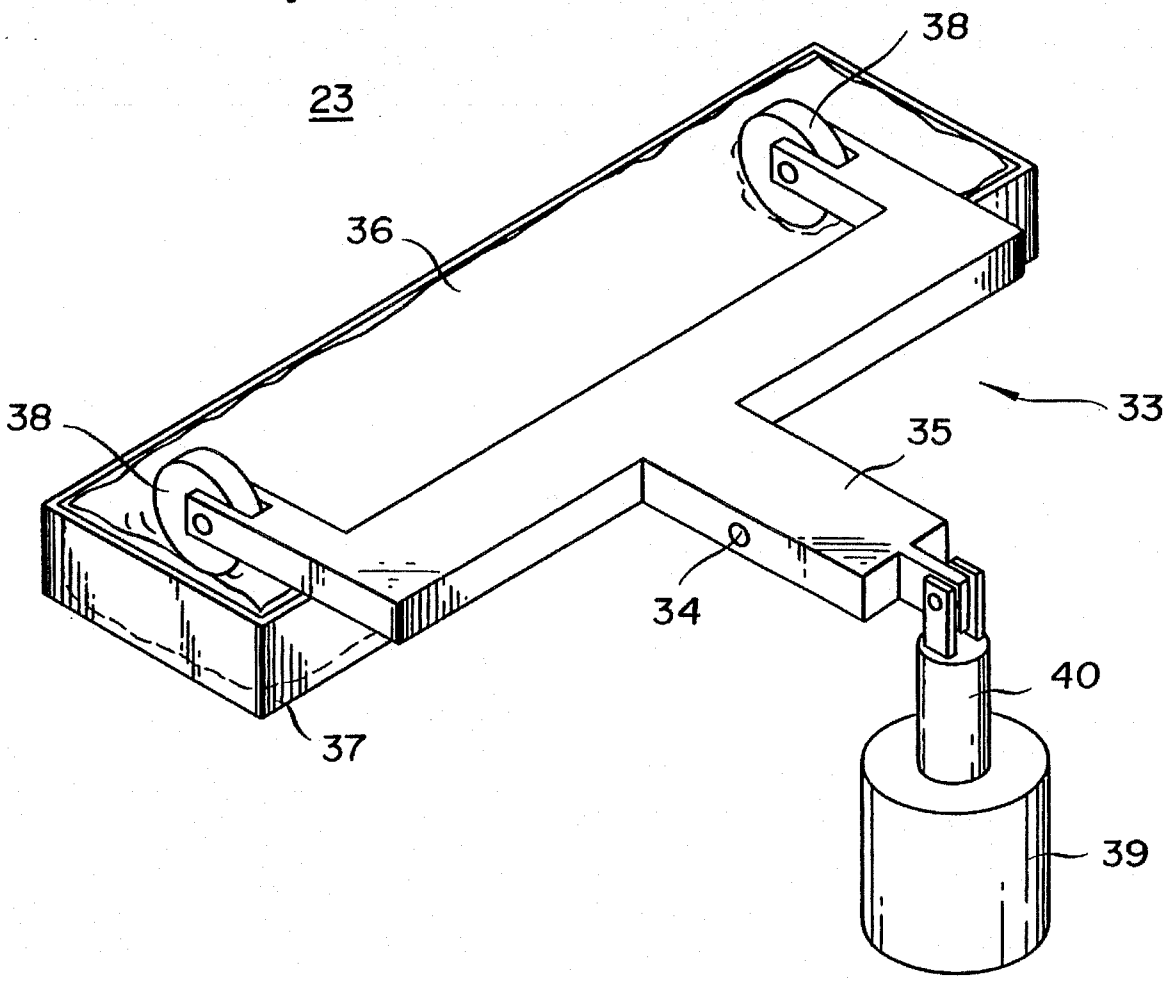
FIG. 3 is a perspective view illustrating a marking unit shown in FIG. 1.

The details of this marking unit 33 are shown in FIG. 3.

This unit 33 is provided with an arm 35 rotatably attached to a supporting shaft 34 which is fixed inside the copying device and an ink container 37 holding therein a sponge 36 impregnated with ink. To the leading end of a forked part of the arm 35, two ink rollers 38 made of felt are rotatably attached. To the other end of the arm 35, a rod 40 moved up and down by a solenoid 39 is connected. When the solenoid 39 is turned off, the ink rollers 38 are lowered under their own weight and allowed to alight on the sponge 36. Conversely, when the solenoid 39 is turned on, the rod 40 of the solenoid 39 contracts and sets the arm 35 rotating clockwise in the bearings shown in FIG. 3. As a result, the ink roller 38 ascends and collides against the reverse surface of the recording paper P and prints on the reverse surface a mark indicating the unnecessariness of the image information. The ink container 37 is freely detachable relative to the copying device. The container 37 is reproved when the ink is used up or when the ink is to be replaced with an ink of some other color. Since the reverse surface information sensor 31 must discern infallibly the presence or absence of image information on the reverse surface, the distance between the ink roller 38 of the marking unit 33 and the reverse surface information sensor 31 is desired to exceed at least the length of the recording paper in use in the direction of conveyance thereof.

Figure 4:
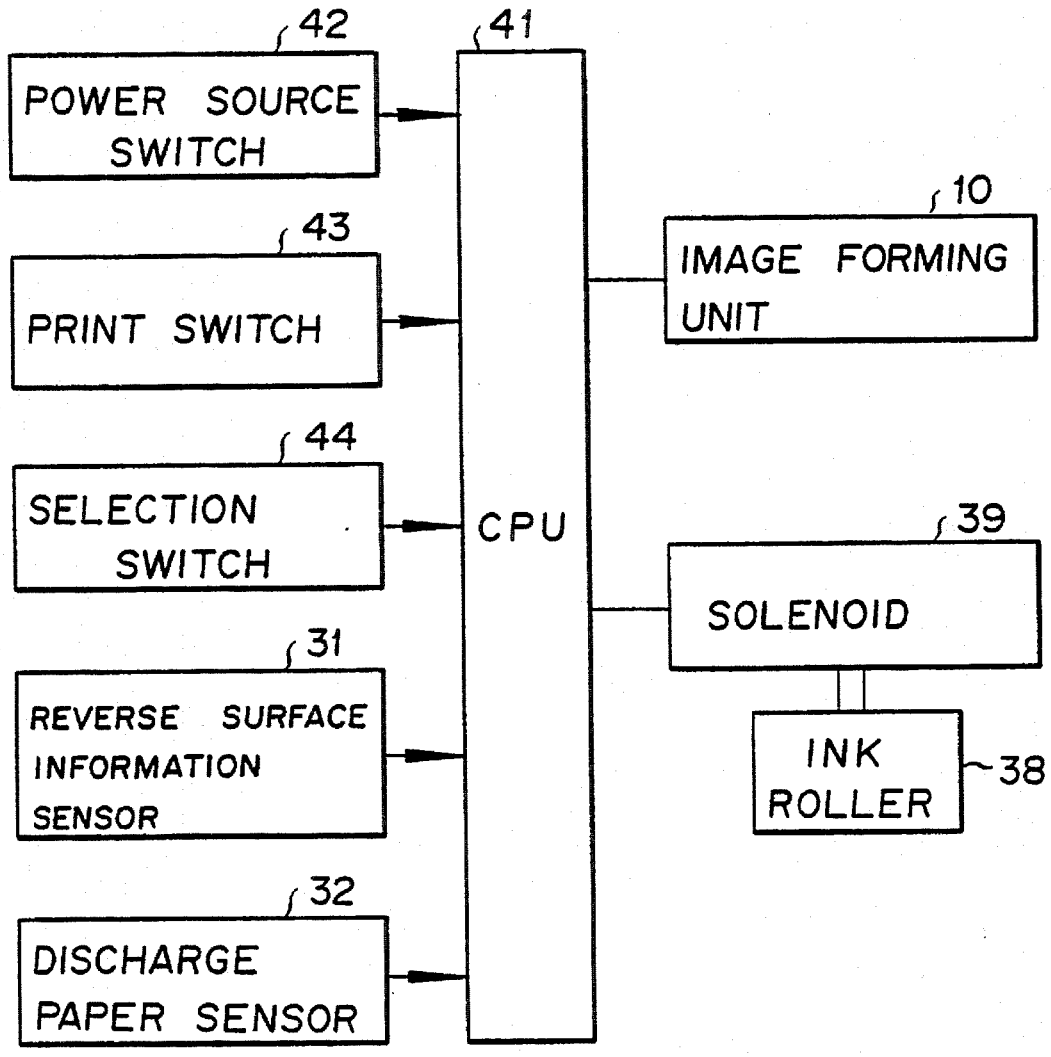
FIG. 4 is a block diagram illustrating a control circuit for the copying device shown in FIG. 1.

FIG. 4 is a block diagram illustrating a control circuit for the copying device shown in FIG. 1. A power source switch 42 is connected to a CPU 41. This power source switch 42 is a main switch for the copying device. All of the functions of the copying device are stopped when this switch 42 is turned off. A print switch 43 is operated for producing a copying operation. When this switch is turned on, the conveyance of a recording paper is initiated and, at the same time, the copying operation by the image forming unit 10 is started. A selection switch 44 is adapted to be used by the operator of the image forming apparatus in selecting between printing and not printing on the reverse surface of a recording paper P a mark indicating unnecessariness of image information when the reverse surface information sensor 31 detects the fact that image information has been already recorded on the reverse surface of the recording paper P. So long as this switch 44 is kept on, the image forming apparatus is set in the marking mode in which the marking unit 33 prints the mark on the reverse surface of the recording paper P only when the image information has been already recorded on the reverse surface. While this switch 44 is kept off, the marking mode is not set and the marking unit 33 refrains from printing the mark irrespectively of the presence or absence of the image information on the reverse surface. The sensors and the switches shown in FIG. 4 are connected to the CPU 41. From the CPU 41, control signals are sent to the component members of the image forming unit 10 such as the photosensitive drum 11 and to the solenoid 39 of the marking unit 33.

The reverse surface information sensor 31 is adapted to effect detection as to whether or not the delivered recording paper has image information already recorded on the reverse surface thereof. A reflection type photosensor, for example, may be used as the sensor 31. The CPU 41, on the basis of the outcome of this detection of the sensor 31, computes density distribution on the reverse surface of the recording paper and discerns the presence or absence of image information on the reverse surface. The discharge paper sensor 32 is adapted to detect the fact that a recording paper which has undergone the copying operation is safely discharged onto the paper discharging tray 26. In the present embodiment, this sensor 32 is used for timing the operation of the solenoid 39. The solenoid 39 is set actuating when the recording paper being discharged is detected by the sensor 32 and, by this operation of the solenoid 39, the ink roller 38 is pressed against the reverse surface of the recording paper P. The power source switch 42, the print switch 43, and the selection switch 44 are mounted on the operating panel (not shown) of the copying device. The reverse surface information sensor 31 and the discharge paper sensor 32 are disposed at the positions shown in FIG. 1.

Figure 5:
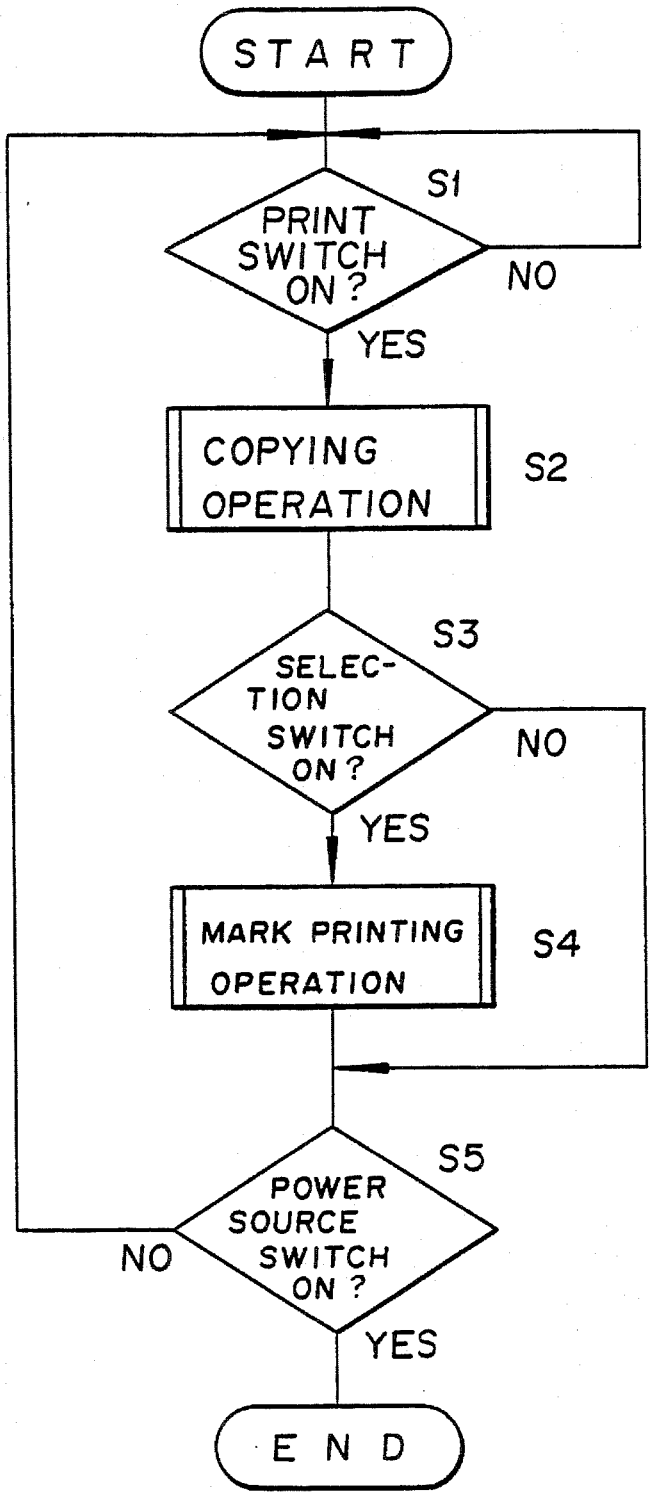
FIG. 5 is a flow chart illustrating a main routine indicating the operating condition of the image forming apparatus.

The procedure for image formation by the use of the image forming apparatus described above will be described below with reference to the flow charts of FIG. 5 and FIG. 6.

When the fact that the print switch 43 has been operated is detected at Step S1, a control signal from the CPU 41 is sent to the image forming unit 10 and, as a results, an ordinary copying operation is executed at Step S2. At this time, the conveyance of a recording paper P is executed. Then, at Step S3, judgment is made as to whether the selection switch 44 has been turned on or off, namely whether or not the marking mode has been set. When the switch 44 is off, the marking mode is not set and the ordinary copying operation is performed. The image forming apparatus, therefore, is kept waiting for the print switch 43 to be turned on next (Step S5). Conversely, when the selection switch 44 is found to be on at Step S3, the mark printing operation is executed at Step S4.

Figure 6:
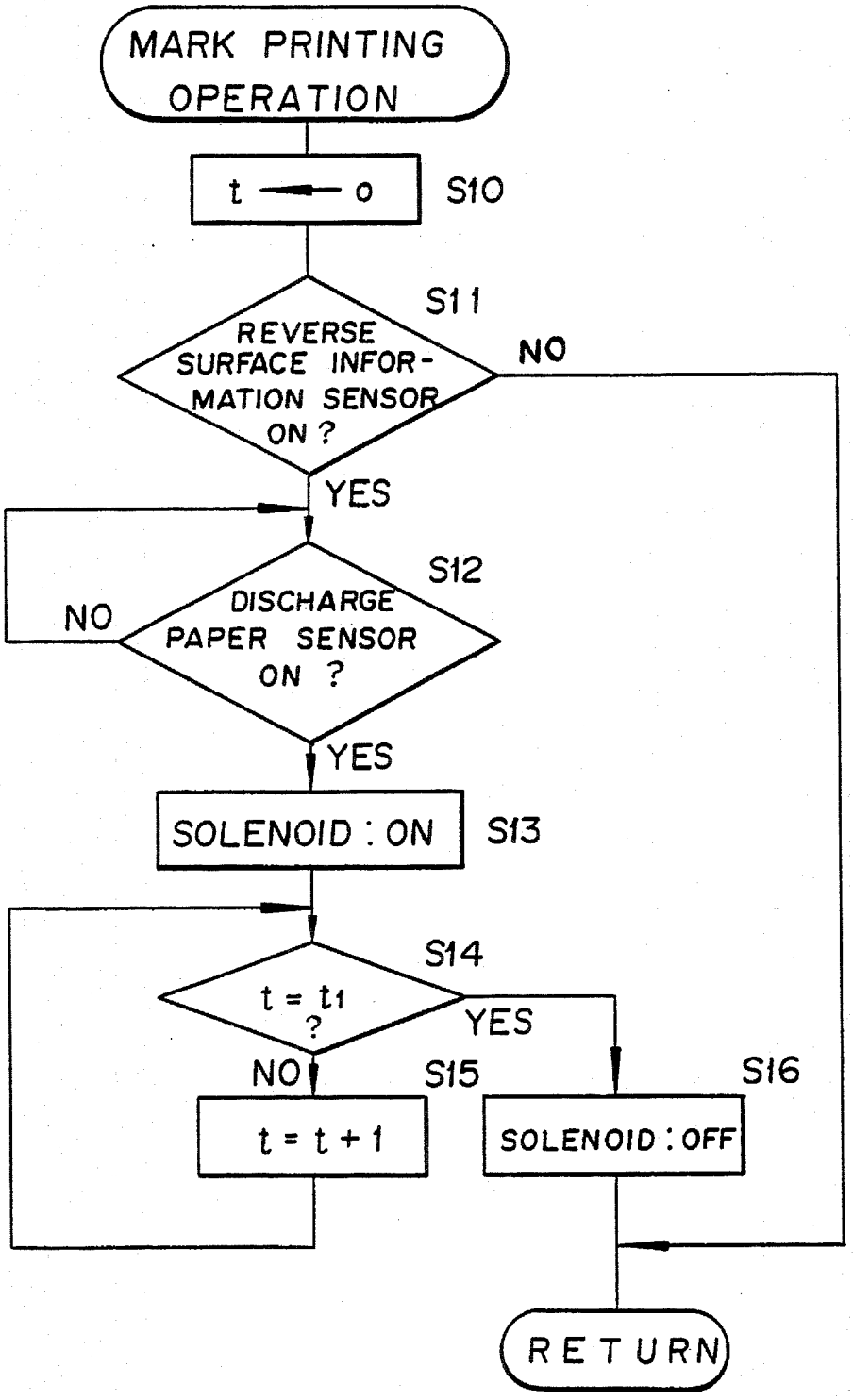
FIG. 6 is a flow chart illustrating a sub-routine for the mark printing operation shown in FIG. 5.

The sub-routine for this mark printing operation is illustrated in FIG. 6. As illustrated in the diagram, when the execution of this sub-routine is started, first the timer installed inside the CPU 41 is reset at Step S10 and, immediately after the delivery of the recording paper P, the reverse surface information sensor 31 surveys the reverse surface of this recording paper and draws a conclusion as to the presence or absence of image information on the reverse surface at Step S11. This detection of the presence or absence of the image information is attained by the CPU 41 performing a relevant computation based on the density distribution of the reverse surface which has been detected by the three reverse surface sensors 31 disposed as illustrated in FIG. 2. The CPU 41 reports the presence of the image information on the reverse surface when the detected density distribution of image information on the reverse surface of the recording paper surpasses a prescribed level or the absence of the image information on the reverse surface when the density distribution is below the prescribed level. When the absence of image information from the reverse surface is discerned, the processing is immediately returned to the main routine of FIG. 5. Conversely, when the presence of the recorded image information on the reverse surface is discerned, the solenoid 39 is turned on as soon as the discharge paper sensor 32 detects the leading end of the recording paper at Step S12. Then, the timer inside the CPU 41 is actuated and the solenoid 39 is turned off when the timer counts up a prescribed time. The detection by the discharge paper sensor 32 of the leading end of the recording paper is relied on as a cue for the actuation of the solenoid 39 for the purpose of enabling the ink roller 38 to be pressed against the reverse surface of the recording paper P while the recording paper is kept nipped by the paper discharge belt 25 thereby enabling a mark to be placed stably on the reverse surface of the recording paper (Steps S14 to S16).

Figure 7A:
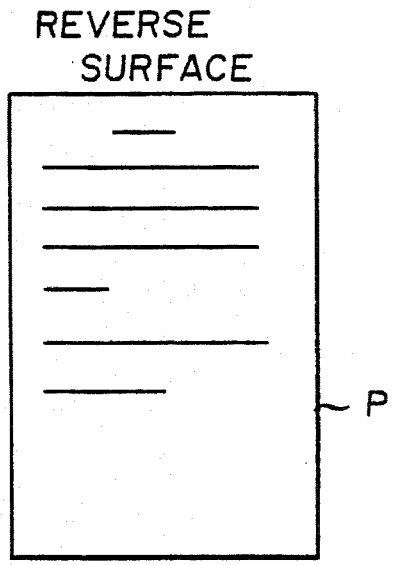
FIG. 7A is a plan view illustrating the reverse surface of a typical used recording paper.
Figure 7B:
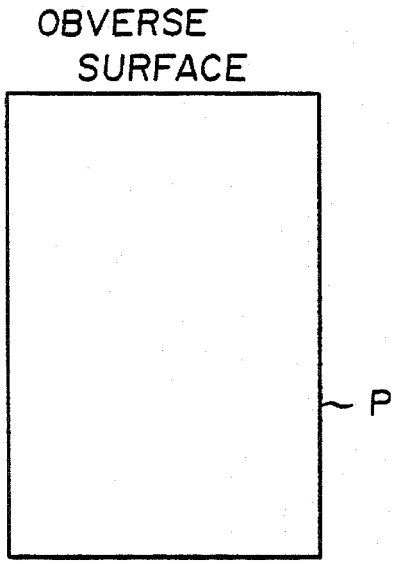
FIG. 7B is a plan view illustrating the obverse surface of the recording paper shown in FIG. 7A.
Figure 8A:
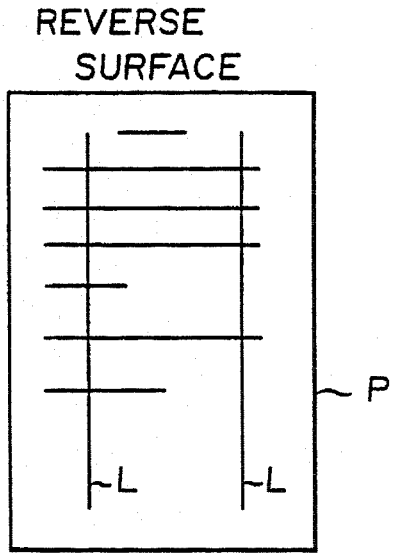
FIG. 8A is a plan view illustrating the reverse surface of the recording paper shown in FIG. 7A having line marks formed on the reverse surface thereof.
Figure 8B:
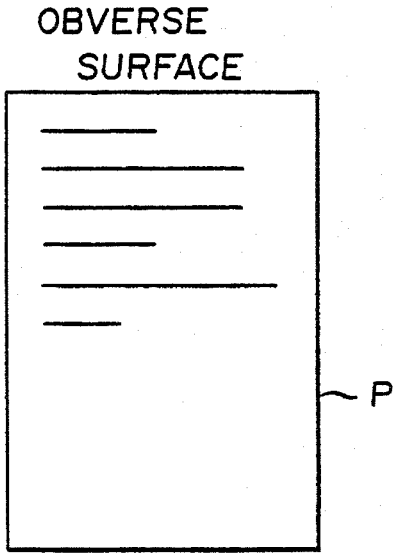
FIG. 8B is a plan view illustrating the obverse surface of the recording paper shown in FIG. 7B having an image formed on the obverse surface thereof.

Let us assume a case in which a recording paper P having image information of some sort or other already recorded on the reverse surface thereof as illustrated in FIG. 7A is to be used for having image information copied anew on the obverse surface thereof shown in FIG. 7B. In this case, since the presence of the image information on the reverse surface of the recording paper P is detected by the reverse surface information sensor 31, line marks L are printed on the reverse surface by the ink roller 38 of the marking unit 33 as illustrated in FIG. 8A and the new image information is copied on the obverse surface as illustrated in FIG. 8B. Since these line marks L are inscribed on the reverse surface by the marking unit 33 as described above, the unnecessary image information on the reverse surface can be easily discriminated from the newly copied image information. The operation described thus far is obtained when the selection switch 44 is on. The inscription of the line marks L by the marking unit 33 is not effected when the selection switch 44 is off. The selection switch 44, therefore, may be kept off while the double-face copying for forming image information on the opposite surfaces of the unused recording paper P is in process. Even when the selection switch 44 is on, since an unused recording paper, i.e. the recording paper having absolutely no information such as of characters recorded on the reverse surface thereof, is automatically discerned by the reverse surface information sensor 31, the inscription of line marks L on the reverse surface of the unused recording paper can be precluded.

In the apparatus of the first embodiment described above, the selection between operating and not operating the marking unit 33 is effected by the operator manually manipulating the selection switch 44. Optionally, the operation of the marking unit 33 may be automated as in the second embodiment to be described below.

Figure 9:
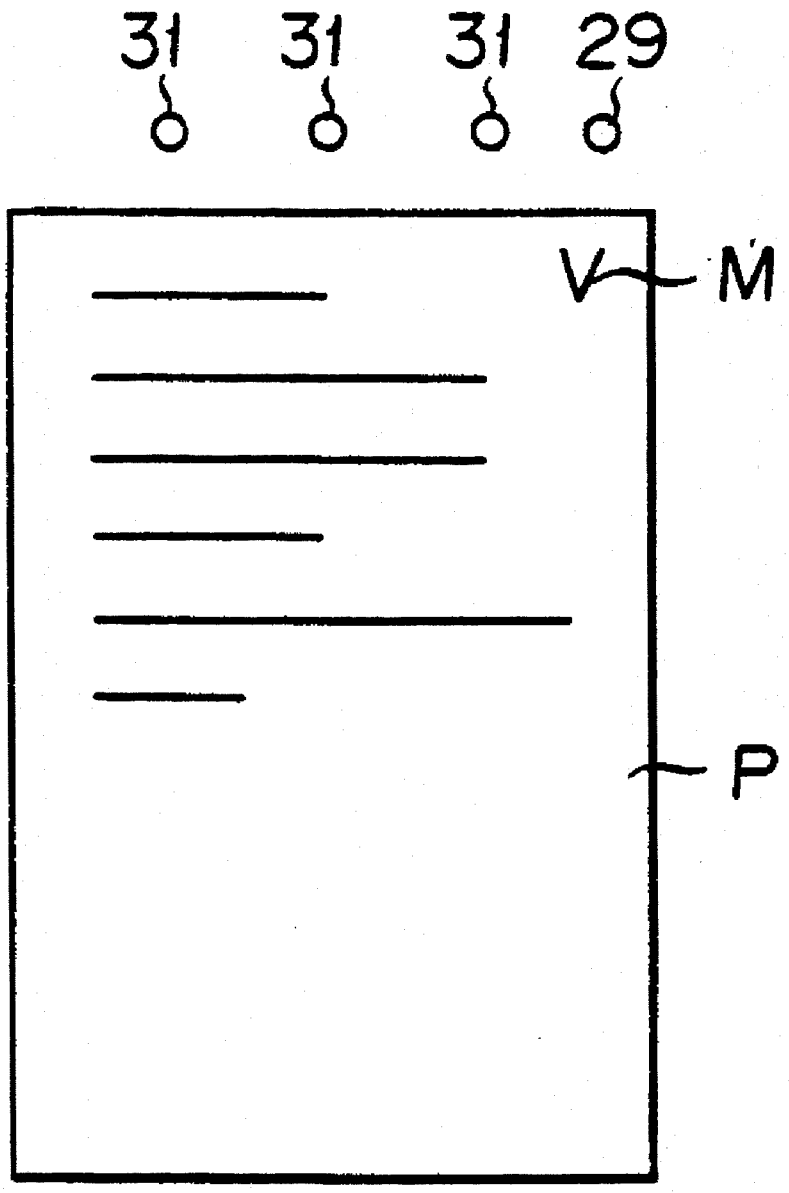
FIG. 9 is a plan view illustrating the layout of used mark sensors incorporated in the second embodiment.

In this case, a used mark sensor 29 is disposed in close proximity to the reverse surface information sensor 31 shown in FIG. 1. The positional relationship of the used mark sensor 29 to the reverse surface information sensor 31 is illustrated in FIG. 9. This sensor 29, as illustrated in FIG. 9, is adapted to detect a used mark M which the user has marked in advance on the reversed surface of the used recording paper P having unnecessary information already recorded thereon. The signal of this detection issued by this sensor is sent to the CPU 41 shown in FIG. 4.

Figure 10:
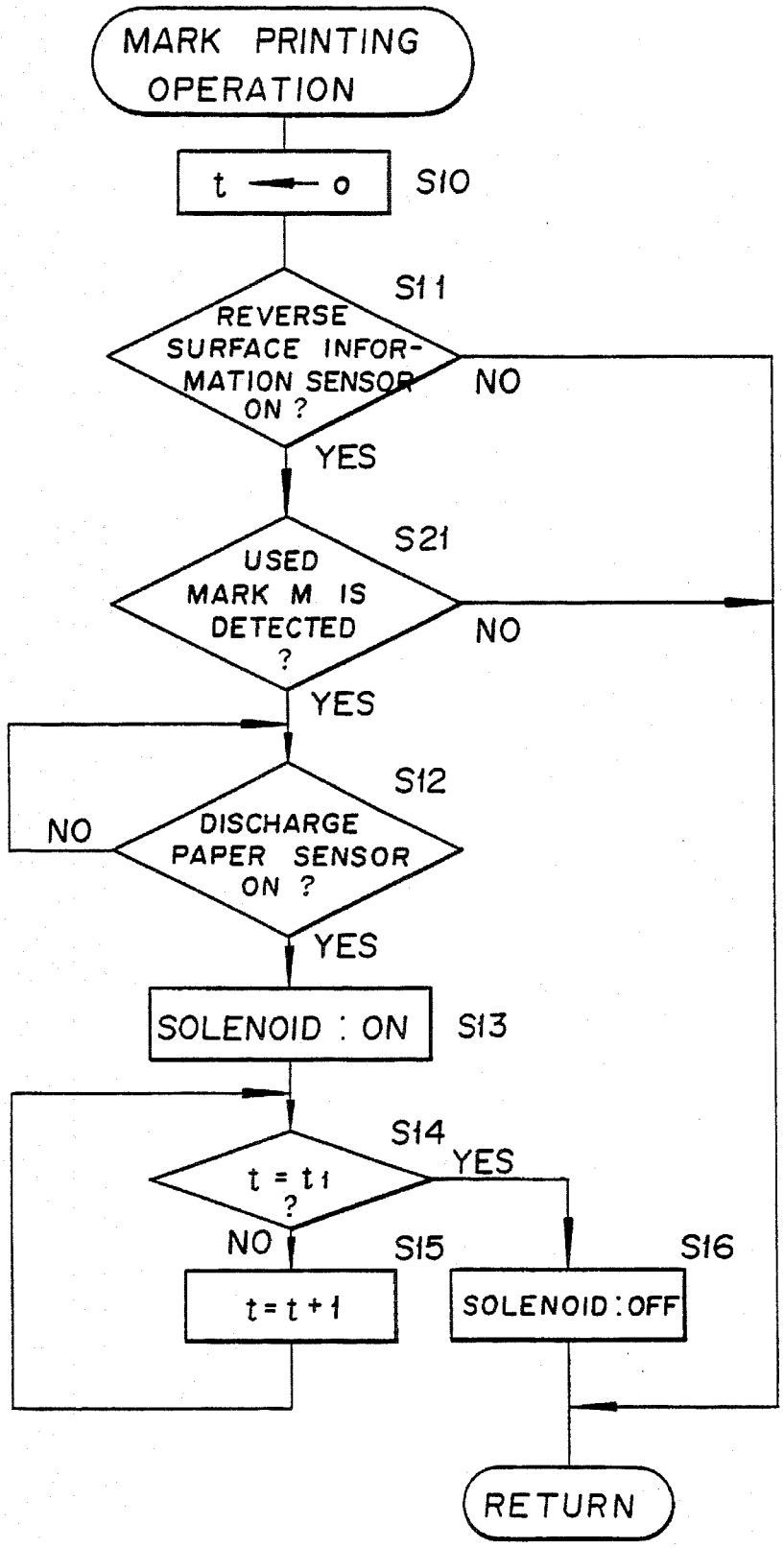
FIG. 10 is a flow chart illustrating the operating condition of the second embodiment shown in FIG. 9, corresponding to FIG. 6 illustrating that of the first embodiments.

The operation to be performed with the image forming apparatus of the second embodiment is illustrated in FIG. 10. This diagram corresponds to that of FIG. 6 illustrating the preceding embodiment. The operation of the image forming apparatus of the second embodiment will be explained below with reference to the flow chart of FIG. 10 illustrating this sub-routine. The mark printing operation is executed when the fact that the selection switch 44 is on is discerned in the same manner as in the apparatus of FIG. 5. Step S21 is executed when the fact that the reverse surface of the recording paper P has image information already recorded thereon is discerned at Step S11. When the used mark M marked in advance by the user on the reverse surface of the recording paper is detected by the used mark sensor 29 at Step S21, the marking unit 33 inscribes the line marks L on the reverse surface at Steps S13 to S16. The inscription of the line marks L is not executed when no image information is recorded and no used mark M is printed on the reverse surface. In this case, therefore, even when recording papers having unnecessary image information already formed on the reverse surfaces thereof, recording papers verging on a double-face copying operation, and recording papers yet to be used are stowed in a mingling state in the paper feeding tray 21, for example, the marks M marked in advance exclusively on the recording papers having unnecessary image information already formed thereon enable lines L to be printed only on the recording papers having the marks M marked on the reverse surfaces thereof and also having image information already recorded on the reverse surfaces and, therefore, allow only the recording papers having unnecessary image information formed thereon to be automatically selected for the purpose of inscription of lines L. The apparatus of the second embodiment thus adapted, therefore, enjoys greater ease of use than the apparatus of the first embodiment adapted to allow unified selection of the operation of the marking unit 33. Of course, the inscription of line marks L on the reverse surfaces of the recording papers P is not executed when the selection switch 44 is off.

The used mark M shown in FIG. 9 need not be limited to the shape illustrated but may be in any of various shapes. The shape of this used mark M is not critical but is only required to be discerned by the mark sensor 29. The used marks M need not be limited to be marked on the reverse surfaces of the recording papers but may be marked on the obverse surfaces of the recording papers.

Figure 11:
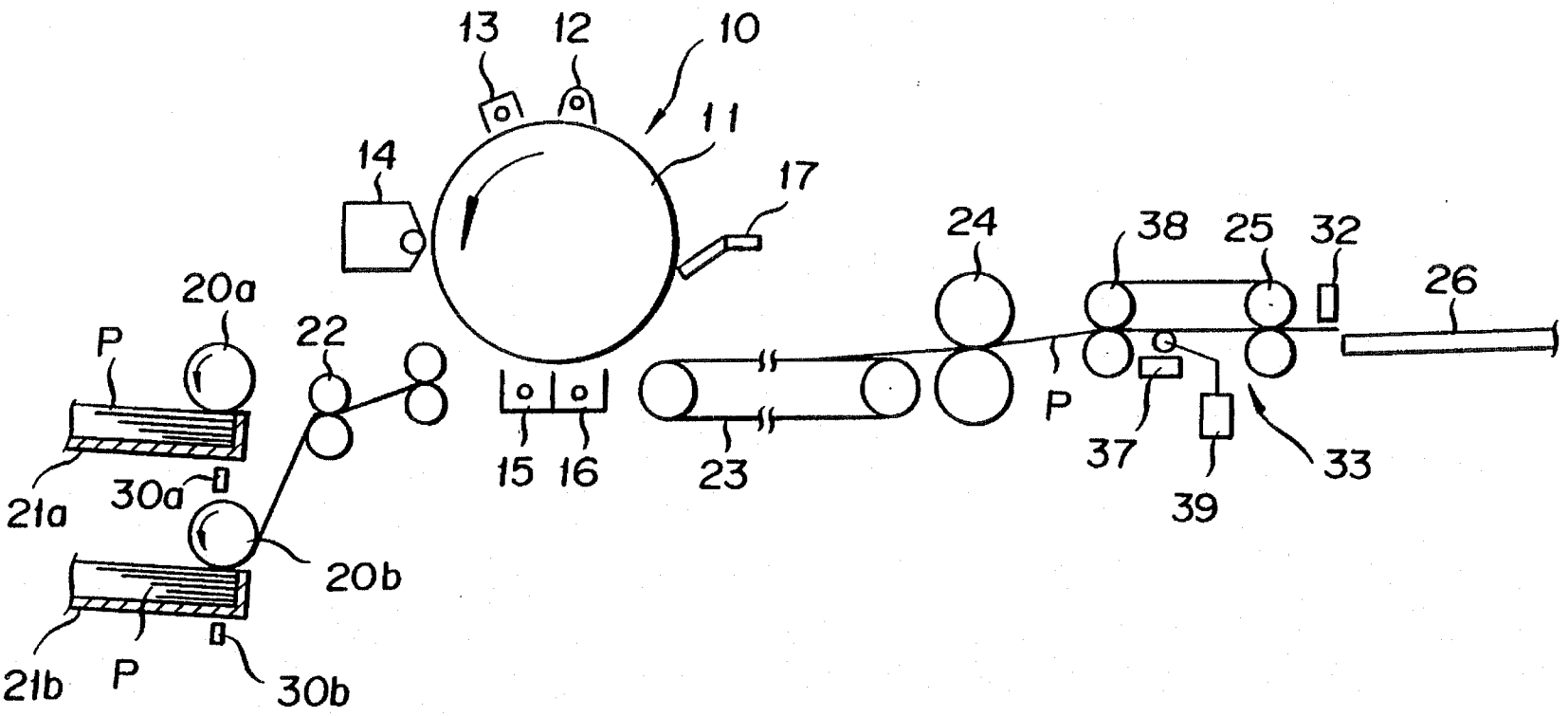
FIG. 11 is a cross section illustrating the part of an image forming apparatus as the third embodiment corresponding to what is illustrated in FIG. 1.
Figure 12:
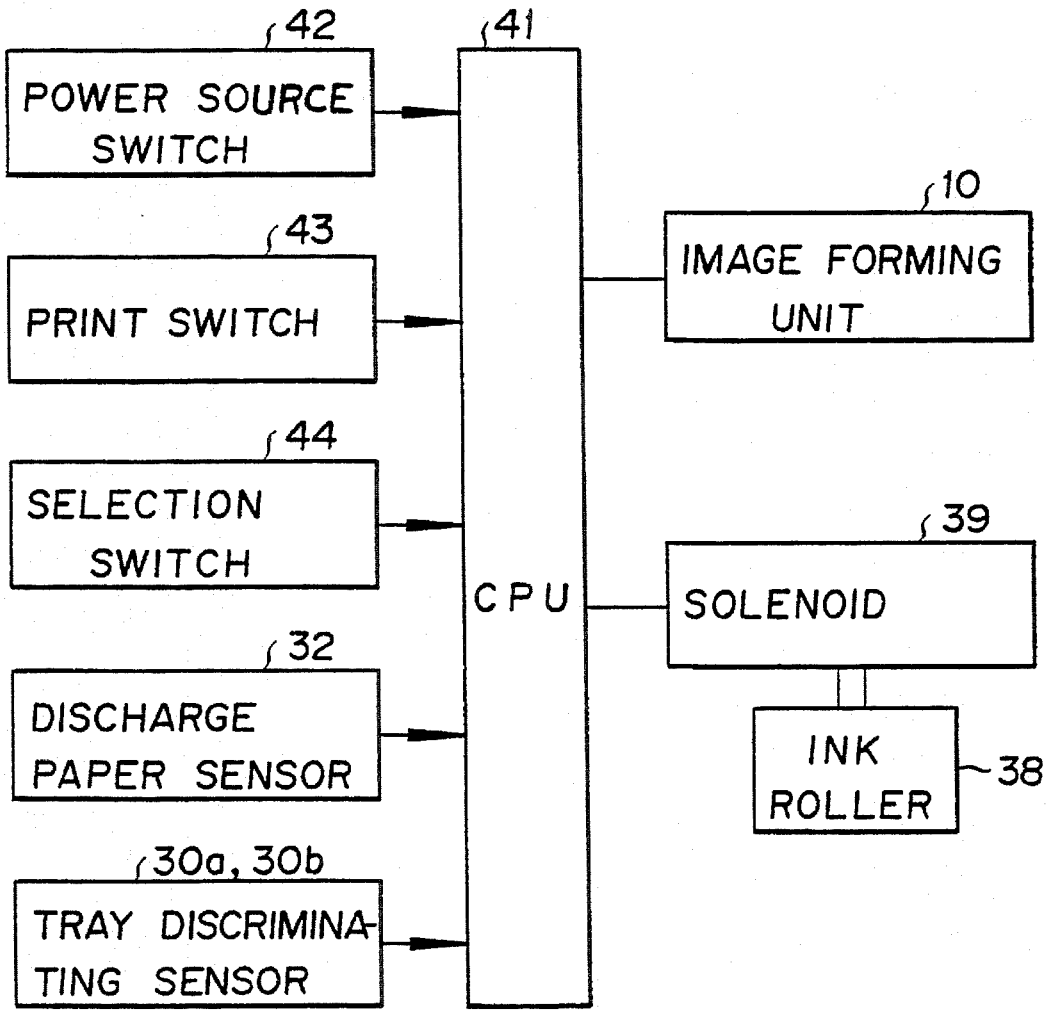
FIG. 12 is a block diagram illustrating a control circuit of the image forming apparatus shown in FIG. 11.
Figure 13:
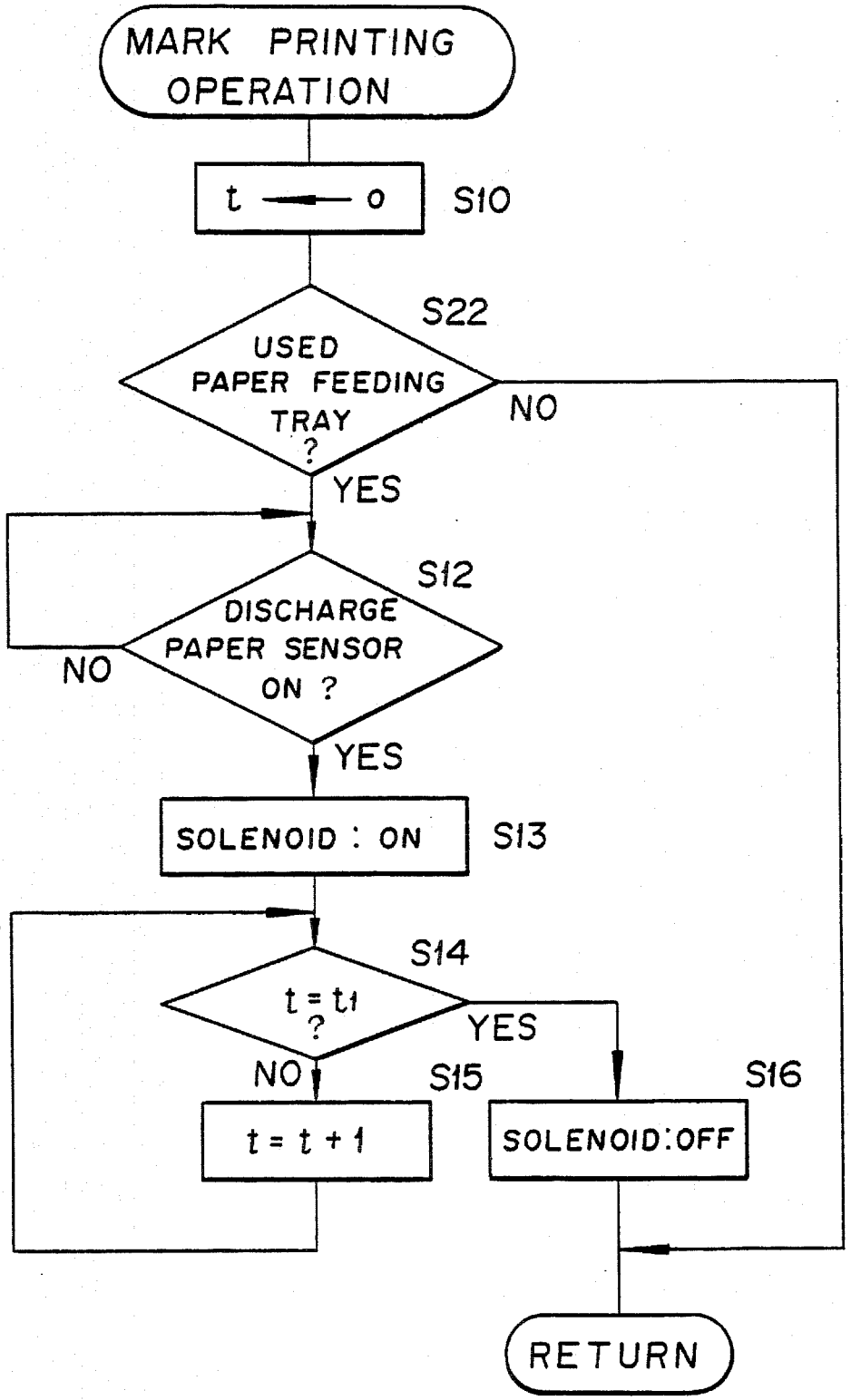
FIG. 13 is a flow chart illustrating the operating condition of the image forming apparatus shown in FIG. 11 and FIG. 12.

FIG. 11 to FIG. 13 illustrate an image forming apparatus as the third embodiment of this invention. In these diagrams, the component members equaling those of the preceding embodiments are denoted by equal reference numerals.

This image forming apparatus, as illustrated in FIG. 11, has a plurality of paper feeding trays 21*a* and 21*b* detachably incorporated therein. From these trays, recording papers are played out by riffling rollers 20*a* and 20*b*. Either of these two paper feeding trays is used exclusively for accommodating used recording papers. When the paper feeding tray 21*b* serves as a tray for accommodating used recording papers, for example, the used recording papers are stored in this tray 21*b* as piled up in such a manner that the reverse surfaces thereof having information already recorded thereon face downwardly. A notch incised in the bottom surface of the paper feeding tray 21*b* or a bar code applied to the bottom surface allows this tray 21*b* to be identified as the tray used exclusively for accommodating used recording papers. Thus, the notch or the bar code serves as means for designating a specific part for accommodation. To allow ready discrimination between the specific purposes for which these trays are used, tray discriminating sensors 30*a*, 30*b* are placed on the lower sides of these trays 21*a*, 21*b*.

The control circuit for the image forming apparatus illustrated in FIG. 11 is shown in FIG. 12. The signals of detection issued from the tray discriminating sensors 30*a*, 30*b* are sent to the CPU 41. The operation of this image forming apparatus is illustrated in FIG. 13. When the recording papers accommodated in the lower used paper feeding tray 21*b* are to be fed out, therefore, this fact is discerned at Step S22. In this case, since the recording papers fed from the used paper feeding tray 21*b* have information already recorded on their reverse surfaces without fail and, therefore, have no use for the reverse surface information sensor 31, line marks L are inscribed infallibly on the reverse surfaces of the recording papers P from this tray 21*b*. In the third embodiment, the operation of Step S3 in the flow chart of the main routine illustrated in FIG. 5 need not be performed for the purpose of infallibly inscribing lines L on the reverse surfaces of the recording papers fed from the paper feeding tray 21*b*. Optionally, the operation of Step S3 may be nevertheless executed.

In the third embodiment illustrated in FIG. 11 to FIG. 13, the question as to which of the plurality of paper feeding trays is destined to accommodate used recording papers is decided by the tray discriminating sensors 30*a* and 30*b*. When the particular tray for accommodating used recording papers is set from the beginning, the apparatus has no use for the discriminating sensors 30*a* and 30*b*. In this case, the lower paper feeding tray 21*b* illustrated in FIG. 11, for example, is selected for the accommodation of used recording papers. In the present embodiment, therefore, the marks are inscribed on the reverse surfaces of only the recording papers supplied through the paper feeding port of the lower paper feeding tray 30*b*. The flow chart of this fourth embodiment is illustrated in FIG. 14.

Figure 14:
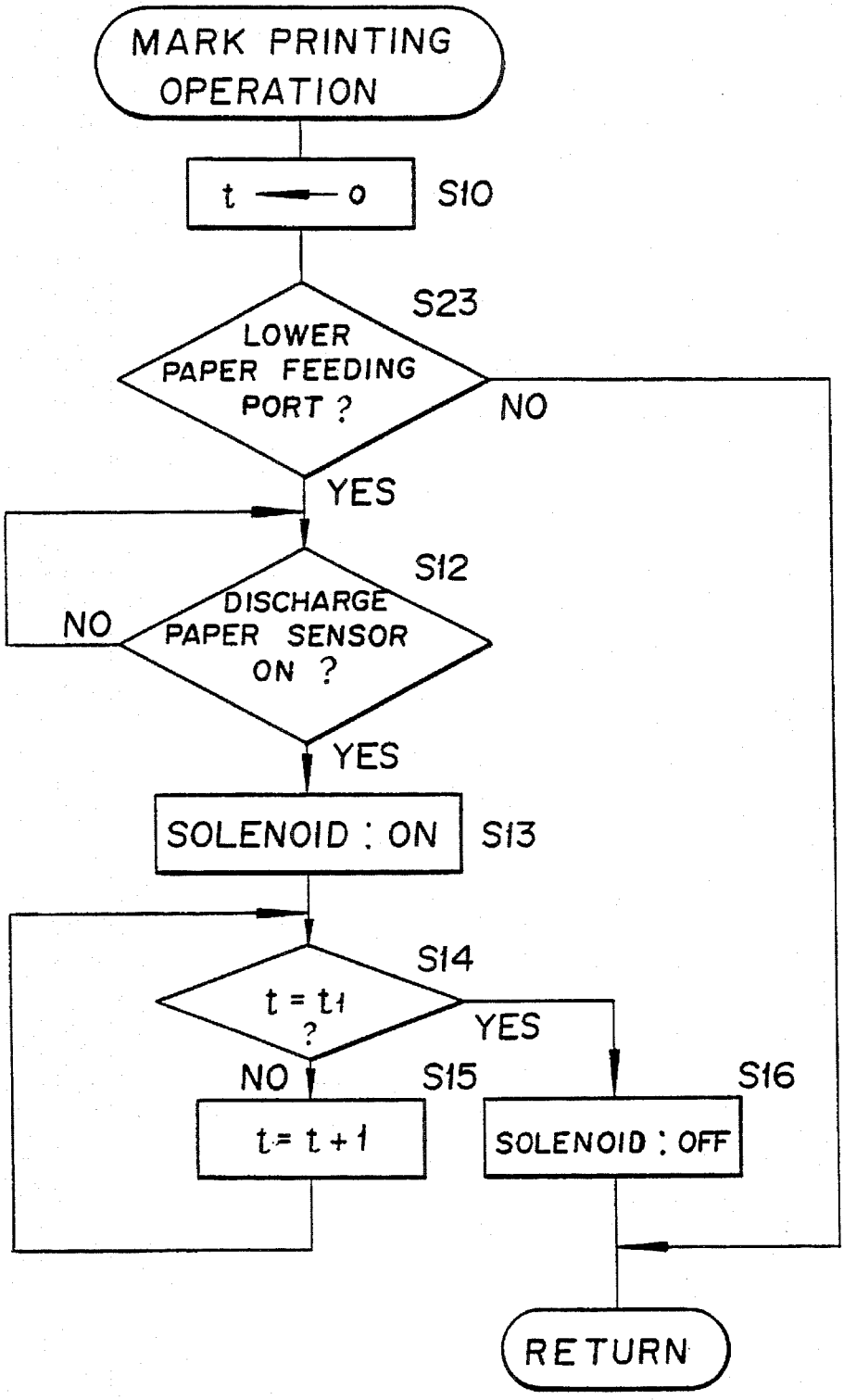
FIG. 14 is a flow chart illustrating the operating conditions of an image forming apparatus as the fourth embodiment of the present invention.

As illustrated in FIG. 14, the question as to whether or not the recording papers have been supplied through the lower paper feeding port from the paper feeding tray 21*b* accommodating used recording papers is decided at Step S23. When YES is the answer at Step S23, the operation from Step S12 onward is executed. Again in this case, the apparatus finds no use for the reverse surface information sensor 31 similarly to the copying device in the third embodiment. Further, the operation of Step S3 of the main flow chart illustrated in FIG. 5 may be executed or not executed.

The embodiments described thus far invariably represent a case in which the inscription of marks by the use of the ink roller 38 on the reverse surfaces has been depicted as means for indicating unnecessariness of image information formed on the reverse surfaces. The use of this means is not critical. The impression of such marks by the use of a stamp, for example, may be resorted to instead. The marking or print to be inscribed by means of the ink roller 38 need not be limited to two lines but may be a slanted line and the like instead, as a matter of course. Optionally, a plurality of marking units 33 may be disposed as suitably distributed. The color of this marking may be freely selected on the sole condition that it should be easily discriminated from the color of the image information formed on the reverse surfaces of the recording papers. Optionally, a plurality of colors may be used. The marking unit 33 may be disposed on the upstream side of the photosensitive drum 11 when it is used after the presence of image information on the reverse surface has been detected by the reverse surface information sensor 31. Further, the reverse surface information sensor 31 may be disposed on the downstream side of the photosensitive drum 11 when the printing is subsequently accomplished by means of the marking unit 33.

For the purpose of clearly indicating unnecessariness of the image information recorded on the reverse surface, an all over image may be formed with a toner or ink of black or other color of medium density on the entire reverse surface as by transfer. This arrangement prevents such a disadvantage that, when images are formed as by the copying device on the obverse surfaces of the recording papers having already formed images on reverse surfaces, it is hard to identify the image information formed on the obverse surfaces because of permeation of the images formed on the reverse surfaces through the paper.

The marking unit 33, of course, may be constructed of image forming means inherently possessed by a copying device or a printer or of some other generally conceived means besides the concrete example cited above. Examples of the shape of the mark to be inscribed by the marking unit on the reverse surface are characters "used" and "not necessary," corporate appellations, company appellations, mottos, phrases of advertisement, special signs such as CI (Corporate Identity) designs, and patterns besides the lines and the stamps cited above. The use of such a fancy shape is effective not only in indicating unnecessariness of image information on the reverse surface but also in promoting business advertisement.

In the embodiments described thus far, the copying device has been cited as means for effecting further utilization of recording papers. The image forming devices available for the embodiment of this invention further embrace such printers as dot printers, color printers, and ink jet printers. Further, in the embodiments cited above, the series of operations for the formation of image information on the obverse surface have been described as involving the operation of the marking unit in the printing of the mark on the reverse surface simultaneously with the formation of image. Optionally, the image forming apparatus may be used exclusively for inscribing the mark on the reverse surface.

While this invention has been illustrated and described in accordance with a preferred embodiment, it is recognized that variations and changes may be made and equivalents employed herein without departing from the invention as set forth in the claims.

What is claimed is:

1. An image apparatus comprising a cassette for placing a sheet therein, a sheet feed means for feeding the sheet placed in the cassette into an apparatus body, an image forming means for forming an image on the sheet fed into the apparatus body and a sheet discharge means for discharging the sheet having an image thereon out of the apparatus body, which comprises:

a marking means for marking one surface of the sheet, the sheet having a surface on which an image is formed and a reverse surface;

a used surface detection means for detecting if the reverse surface of the sheet is a surface which has been used; and a marking control means for controlling the marking means so that a surface of the sheet is marked when the reverse surface of the sheet is detected by the used surface detection means as having already been used.

2. An image forming apparatus comprising:

discerning means for discerning the presence or absence of information on a reverse surface of a recording paper;

marking means disposed on a downstream side of said discerning means in the direction of conveyance of the recording paper for marking on the reverse surface of the recording paper a mark indicating that the image information is unnecessary when said discerning means discerns the presence of information on the reverse surface;

selecting means for selecting marking mode or non-marking mode; and control means for controlling the operation of said marking means when said marking mode is selected by said selecting means.

3. The image forming apparatus as claimed in claim 2, wherein the distance between said discerning means and said marking means is longer than a length of the recording paper in the direction of conveyance of the recording paper.

4. The image forming apparatus as claimed in claim 2, further comprising first detection means for detecting a mark which is manually written on the recording paper, wherein said control means controls the operation of said marking means when said selecting means selects the marking mode and said first detection means detects the mark at the same time.

5. The image forming apparatus as claimed in claim 2, wherein said marking means comprises an arm portion which is rotatably supported by a shaft and a marking member which is integrally disposed at one end of said arm portion, said arm portion being connected with a driving portion at another end thereof.

6. The image forming apparatus as claimed in claim 5, further comprising second detection means for detecting a discharge of the recording paper so as to move said marking member to the reverse surface of the recording paper when said second detection means detects the discharge of recording paper.

7. An image forming apparatus comprising:

discerning means for discerning the presence or absence of image information on a reverse surface of a recording paper on which is to be recorded an image on an obverse surface thereof;

detection means for detecting a mark which is manually written on the recording paper;

marking means disposed on a downstream side of said discerning means and detection means in the direction of conveyance of the recording paper for marking on the reverse surface of the recording paper a mark indicating that the image information is unnecessary; and control means for controlling the operation of said marking means when said discerning means discerns that the recording paper has an image information on the reverse surface and the manually written mark is detected by said detection means at the same time.

8. The image forming apparatus as claimed in claim 7 further comprising selecting means for selecting either marking mode or non-marking mode, wherein said control means controls the operation of said marking means when said selecting means selects the marking mode and when any image information on the reverse surface and the mark are detected at the same time.

9. The image forming apparatus as claimed in claim 7, wherein the distance between said discerning means and said marking means is longer than a length of the recording paper in the direction of conveyance of the recording paper.

10. The image forming apparatus as claimed in claim 7, wherein said marking means comprises an arm portion which is rotatably supported by a shaft and a marking member which is integrally disposed at one end of said arm portion, said arm portion is connected with a driving portion at another end thereof.

11. The image forming apparatus as claimed in claim 10 further comprising discharge detection means for detecting a discharge of recording paper so as to move said marking member to the reverse surface of the recording paper when said discharge detection means detects the discharge of recording paper.

12. An image forming apparatus comprising:

feeding means capable of feeding papers from a particular feeding tray which accommodates recording papers where images are to be recorded on each obverse surface and have unnecessary image information on each reverse surface;

detecting means for detecting whether or not said particular feeding tray is in use; and marking means for marking each reverse surface of recording papers when said detecting means detects that said particular feeding tray is in use so as to inscribe that the image information on the reverse surface is unnecessary.

13. The image forming apparatus as claimed in claim 12, further comprising selecting means for selecting marking mode or non-marking mode, wherein said marking means is operated when said detecting means detects that said particular feeding tray is in use and when said marking mode is selected by said selecting means at the same time.

14. The image forming apparatus as claimed in claim 12, further comprising second feeding means having a second feeding tray which accommodates recording papers with no image information on each reverse surface thereof.

15. The image forming apparatus as claimed in claim 12, further comprising a plurality of feeding ports, wherein said feeding tray which accommodates the recording papers with image information on each reverse surface is capable of being attached to any of said feeding ports.

16. The image forming apparatus as claimed in claim 15, wherein said feeding tray has detected means for being detected by detecting means which is disposed in a main body of the image forming apparatus so as to distinguish said feeding tray from the second feeding tray.

17. An image forming apparatus comprising:

first feeding means including a first feeding port for feeding recording papers on which are to be recorded an image on each obverse surface and have unnecessary image information on each reverse surface;

marking means for marking each reverse surface of the recording papers when each of the recording papers is fed from said first feeding port so as to inscribe that the image information on the reverse surface is unnecessary; and second feeding means having a second feeding port from which each of recording papers with no image information on each reverse surface is fed.

18. The image forming apparatus as claimed in claim 17, further comprising selecting means for selecting marking mode or non-marking mode, wherein said marking means is operated when each of the recording papers is fed from said first feeding port and when said marking mode is selected by said selecting means at the same time.

* * * * *